US006402306B1

(12) United States Patent
Childers et al.

(10) Patent No.: US 6,402,306 B1
(45) Date of Patent: Jun. 11, 2002

(54) METHOD AND APPARATUS FOR REFILLING AN INK CONTAINER

(75) Inventors: Winthrop D. Childers, San Diego, CA (US); David Olsen, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/627,958

(22) Filed: Jul. 28, 2000

(51) Int. Cl.[7] ..... B41J 2/175
(52) U.S. Cl. ..... 347/85
(58) Field of Search ..... 347/5, 6, 7, 85, 347/86, 87

(56) References Cited

U.S. PATENT DOCUMENTS

| | | | | |
|---|---|---|---|---|
| 5,367,328 A | | 11/1994 | Erickson | 347/7 |
| 5,621,445 A | | 4/1997 | Fong et al. | 347/87 |
| 5,663,754 A | | 9/1997 | Lorenze, Jr. et al. | 347/87 |
| 5,673,073 A | | 9/1997 | Childers et al. | 347/86 |
| 5,721,576 A | | 2/1998 | Barinaga | 347/85 |
| 5,790,157 A | | 8/1998 | Higuma et al. | 347/85 |
| 5,880,748 A | * | 3/1999 | Childers et al. | 347/6 |
| 5,903,292 A | | 5/1999 | Scheffellin et al. | 347/86 |
| 5,969,734 A | | 10/1999 | Tamano | 347/85 |
| 6,170,937 B1 | | 1/2001 | Childers et al. | 347/85 |

FOREIGN PATENT DOCUMENTS

| | | | | |
|---|---|---|---|---|
| EP | 0536980 | * | 4/1993 | B41J/2/175 |
| EP | 0803364 A2 | | 10/1997 | B41J/2/175 |
| EP | 0953450 A1 | | 3/1999 | B41J/2/175 |

* cited by examiner

*Primary Examiner*—Anh T. N. Vo
(74) *Attorney, Agent, or Firm*—Kevin B. Sulliyan

(57) ABSTRACT

The present disclosure relates to an apparatus for refilling a replaceable ink container. The ink container has a top and bottom portion relative to a gravitational frame of reference. The replaceable ink container further has a capillary storage member disposed therein and a fluid outlet disposed on the bottom portion. The apparatus for refilling includes a fluid interconnect configured for insertion into the bottom portion to compress the capillary storage member. Included is a back pressure measuring device for determining an amount of ink to fill the replaceable ink container. Also included is an ink delivery device for providing the determined quantity of ink to the replaceable ink container through the fluid interconnect. The ink delivery device is configured to deliver ink to the ink container positioned in a bottom down orientation relative to the gravitational frame of reference to provide ink to the capillary storage member proximate the fluid outlet.

13 Claims, 9 Drawing Sheets

METHOD AND APPARATUS FOR REFILLING AN INK CONTAINER

BACKGROUND OF THE INVENTION

The present invention relates to ink containers for providing ink to inkjet printers. More specifically, the present invention relates to a method and apparatus for refilling a replaceable ink container having a capillary storage member for retaining and providing the controlled release of ink from the ink container.

Inkjet printers frequently make use of an inkjet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system not to move with the carriage.

For the case where the ink supply is not carried with the carriage, the ink supply can be in continuous fluid communication with the printhead by the use of a conduit to replenish the printhead continuously. Alternatively, the printhead can be intermittently connected with the ink supply by positioning the printhead proximate to a filling station that facilitates connection of the printhead to the ink supply.

For the case where the ink supply is carried with the carriage, ink supply may be integral with the printhead, whereupon the entire printhead and ink supply is replaced when ink is exhausted. Alternatively, the ink supply can be carried with the carriage and be separately replaceable from the printhead. For the case where the ink supply is separately replaceable, the ink supply is replaced when exhausted, and the printhead is replaced at the end of printhead life. Regardless of where the ink supply is located within the printing system, it is critical that the ink supply provides a reliable supply of ink to the inkjet printhead.

In addition to providing ink to the inkjet printhead, the ink supply frequently provides additional functions within the printing system, such as maintaining a negative gauge pressure, frequently referred to as a back pressure, within the ink supply and inkjet printhead. Gauge pressure a pressure within the inkjet printhead relative to an atmospheric pressure. This negative gauge pressure must be sufficient so that a head pressure associated with the ink supply is kept at a value that is lower than the atmospheric pressure to prevent leakage of ink from either the ink supply or the inkjet printhead frequently referred to as drooling. The ink supply is required to provide a negative gauge pressure or back pressure over a wide range of temperatures and atmospheric pressures in which the inkjet printer experiences in storage and operation.

There is an ever-present need for ink containers for supplying ink to the inkjet printhead in a reliable manner. These ink containers should provide sufficient back pressure to prevent ink leakage during normal handling and temperature and pressure variations the ink container experiences during normal use and storage. In addition, these ink containers should have relatively low manufacturing costs to reduce the per page printing costs.

SUMMARY OF THE INVENTION

One aspect of the present invention is an apparatus for refilling a replaceable ink container. The ink container has a top and bottom portion relative to a gravitational frame of reference. The replaceable ink container further has a capillary storage member disposed therein and a fluid outlet disposed on the bottom portion. The apparatus for refilling includes a fluid interconnect configured for insertion into the bottom portion to compress the capillary storage member. Included is means for determining an amount of ink to fill the replaceable ink container. Also included is an ink delivery device for providing the determined quantity of ink to the replaceable ink container through the fluid interconnect. The ink delivery device is configured to deliver ink to the ink container positioned in a bottom down orientation relative to the gravitational frame of reference to provide ink to the capillary storage member proximate the fluid outlet.

In one preferred embodiment the means for determining an amount of ink is a back pressure measuring device for measuring back pressure tending to draw ink toward the capillary storage material.

DETAILED DESCRIPTION OF THE PREFERRED EMBODIMENT

Figure 1:
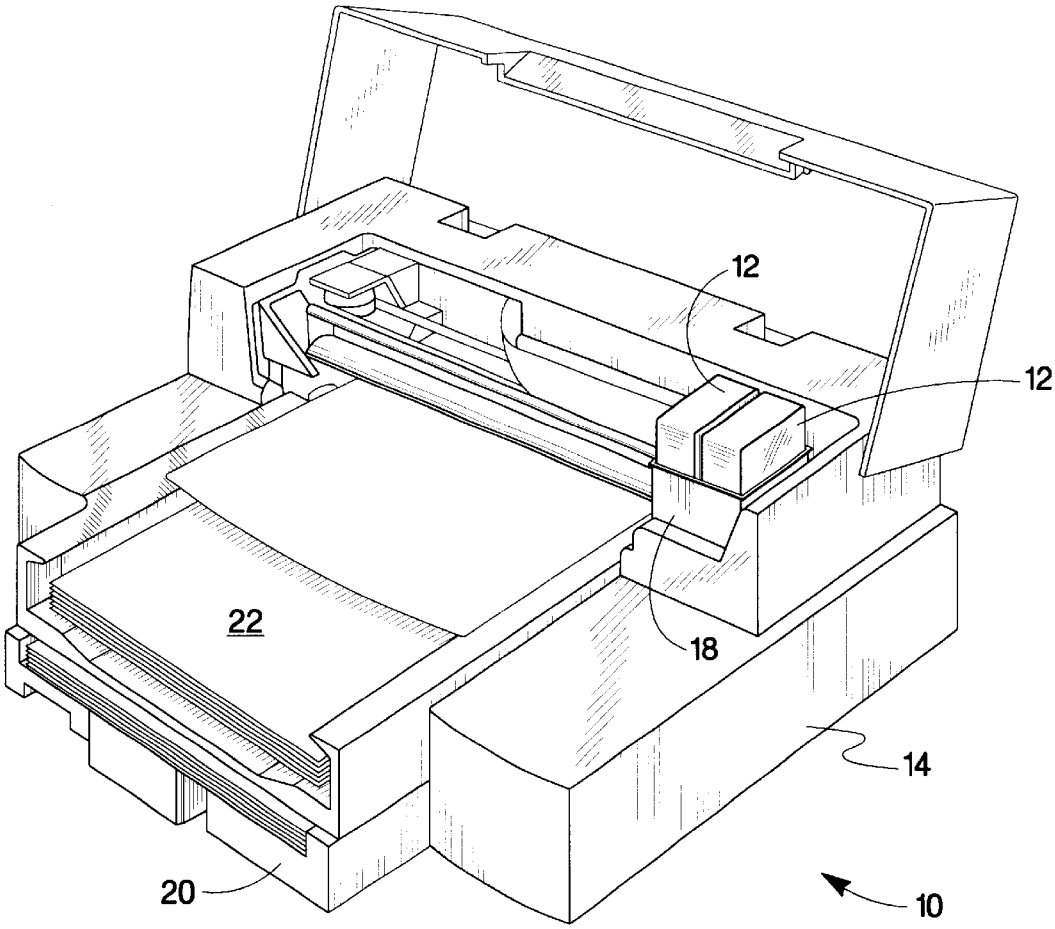
FIG. 1 is an exemplary embodiment of an inkjet printer that incorporates the ink container that is suitable for refilling using the method and apparatus of the present invention.

FIG. 1 is a perspective view of one exemplary embodiment of a printing system 10, shown with its cover open, that includes at least one ink container 12 that is suitable for refilling using the method and apparatus of the present invention. The printing system 10 further includes at least one inkjet printhead (not shown) installed in the printer portion 14. The inkjet printhead is responsive to activation signal from the printer portion 14 to eject ink. The inkjet printhead is replenished with ink by the ink container 12.

Before discussing the details of the method and apparatus of the present invention for refilling ink container 12, it will be helpful to first discuss further detail of the ink container 12. The method and apparatus of the present invention will then be discussed with respect to FIGS. 7–10.

The inkjet printhead is preferably installed in a scanning carriage 18 and moved relative to a print media as shown in FIG. 1. Alternatively, the inkjet printhead is fixed and the print media is moved past the printhead to accomplish printing. The inkjet printer portion 14 includes a media tray 20 for receiving print media 22. As print media 22 is stepped through the print zone, the scanning carriage moves the printhead relative to the print media 22. The printer portion 14 selectively activates the printhead to deposit ink on print media to thereby accomplish printing.

The printing system 10 shown in FIG. 1 is shown with two replaceable ink containers 12 representing an ink container 12 for black ink and a three-color partitioned ink container 12 containing cyan, magenta, and yellow inks, allowing for printing with four colorants. The ink container 12 is suitable for printing systems 10 that make use of fewer or greater numbers of ink colors such as printing systems that use greater or less than 4–ink colors, such as in high fidelity printing which typically uses 6 or more colors.

Figure 2:
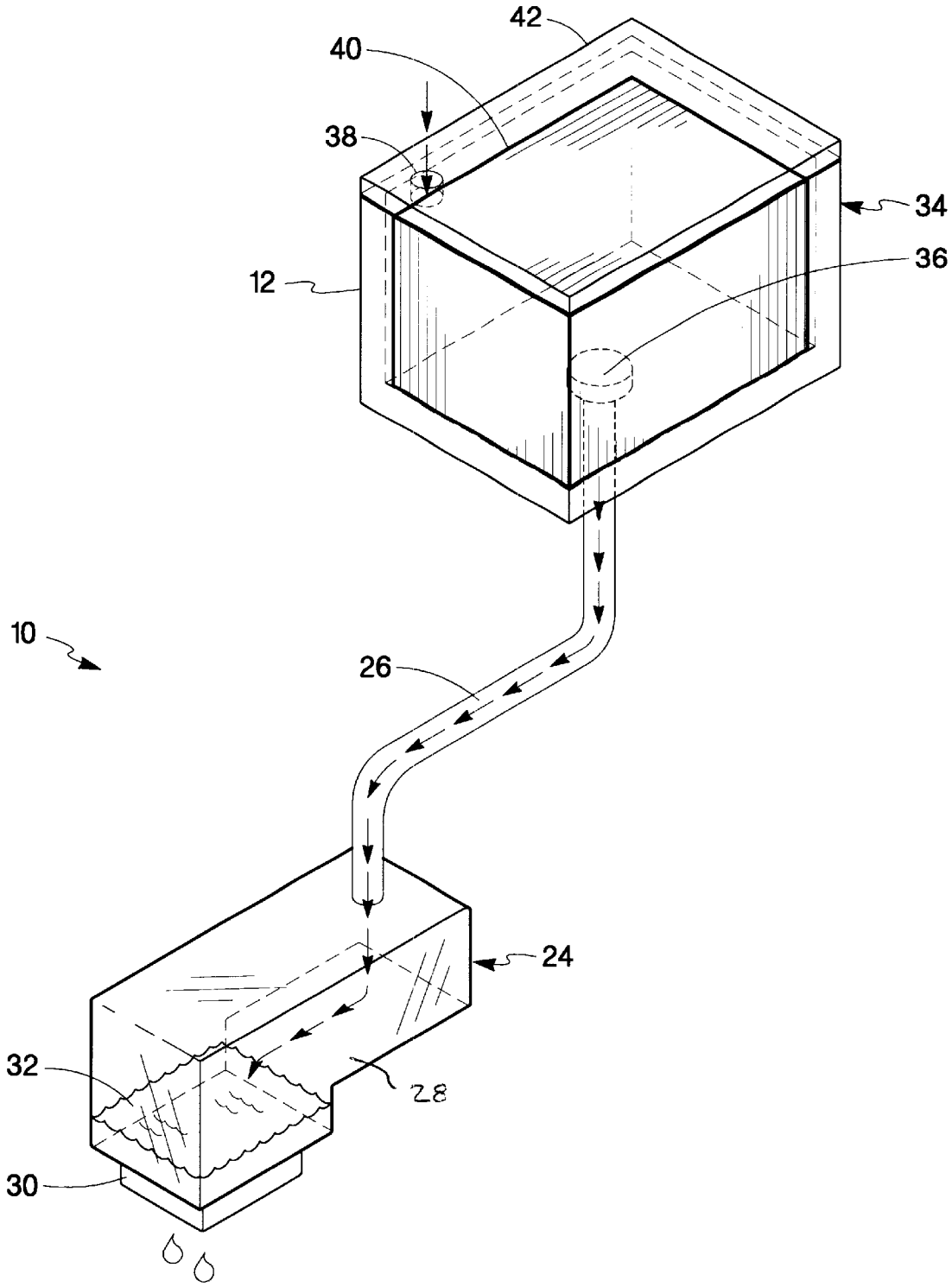
FIG. 2 is a schematic representation of the ink container and an inkjet printhead that receives ink from the ink container to accomplish printing.

FIG. 2 is a schematic representation of the printing system 10 which includes the ink supply or ink container 12, an inkjet printhead 24, and a fluid interconnect 26 for fluidically interconnecting the ink container 12 and the printhead 24.

The printhead 24 includes a housing 28 and an ink ejection portion 30. The ink ejection portion 30 is responsive to activation signals by the printer portion 14 for ejecting ink to accomplish printing. The housing 28 defines a small ink reservoir for containing ink 32 that is used by the ejection portion 30 for ejecting ink. As the inkjet printhead 24 ejects ink or depletes the ink 32 stored in the housing 28, the ink container 12 replenishes the printhead 24. A volume of ink contained in the ink supply 12 is typically significantly larger than a volume of ink container within the housing 28. Therefore, the ink container 12 is a primary supply of ink for the printhead 24.

The ink container 12 includes a reservoir 34 having a fluid outlet 36 and an air inlet 38. Disposed within the reservoir 34 is a network of fibers that are heat fused at points of contact to define a capillary storage member 40. The capillary storage member 40 performs several important functions within the inkjet printing system 10. The capillary storage member 40 must have sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. The capillary should be sufficient to retain ink within the ink container 12 for all orientations of the reservoir 34 as well as undergoing shock and vibration that the ink container 12 may undergo during handling.

Once the ink container 12 is installed into the printing system 10 and fluidically coupled to the printhead by way of fluid interconnect 26, the capillary storage member 40 should allow ink to flow from the ink container 12 to the inkjet printhead 24. As the inkjet printhead 24 ejects ink from the ejection portion 30, a negative gauge pressure, sometimes referred to as a back pressure, is created in the printhead 24. This negative gauge pressure within the printhead 24 should be sufficient to overcome the capillary force retaining ink within the capillary member 40, thereby allowing ink to flow from the ink container 12 into the printhead 24 until equilibrium is reached. Once equilibrium is reached and the gauge pressure within the printhead 24 is equal to the capillary force retaining ink within the ink container 12, ink no longer flows from the ink container 12 to the printhead 24. The gauge pressure in the printhead 24 will generally depend on the rate of ink ejection from the ink ejection portion 30. As the printing rate or ink ejection rate increases, the gauge pressure within the printhead will become more negative causing ink to flow at a higher rate to the printhead 24 from the ink container 12. In one preferred inkjet printing system 10 the printhead 24 produces a maximum back pressure that is equal to 10 inches of water or a negative gauge pressure that is equal to 10 inches of water.

The printhead 24 can have a regulation device included therein for compensation for environmental changes such as temperature and pressure variations. If these variations are not compensated for, then uncontrolled leaking of ink from the printhead ejection portion 30 can occur. In some configurations of the printing system 10 the printhead 24 does not include a regulation device, instead the capillary member 40 is used to maintain a negative back pressure in the printhead 24 over normal pressure and temperature excursions. The capillary force of the capillary member 40 tends to pull ink back to the capillary member, thereby creating a slight negative back pressure within the printhead 24. This slightly negative back pressure tends to prevent ink from leaking or drooling from the ejection portion 30 during changes in atmospheric conditions such as pressure changes and temperature changes. The capillary member 40 should provide sufficient back pressure or negative gauge pressure in the printhead 24 to prevent drooling during normal storage and operating conditions.

The embodiment in FIG. 2 depicts an ink container 12 and a printhead 24 that are each separately replaceable. The ink container 12 is replaced when exhausted and the printhead 24 is replaced at end of life. The method and apparatus of the present invention is applicable to inkjet printing systems 10 having other configurations than those shown in FIG. 2. For example, the ink container 12 and the printhead 24 can be integrated into a single print cartridge. The print cartridge which includes the ink container 12 and the printhead 24 is then replaced when ink within the cartridge is exhausted.

The ink container 12 and printhead 24 shown in FIG. 2 contain a single color ink. Alternatively, the ink container 12 can be partitioned into three separate chambers with each chamber containing a different color ink. In this case, three printheads 24 are required with each printhead in fluid communication with a different chamber within the ink container 12. Other configurations are also possible, such as more or less chambers associated with the ink container 12 as well as partitioning the printhead and providing separate ink colors to different partitions of the printhead or ejection portion 30.

Figure 3:
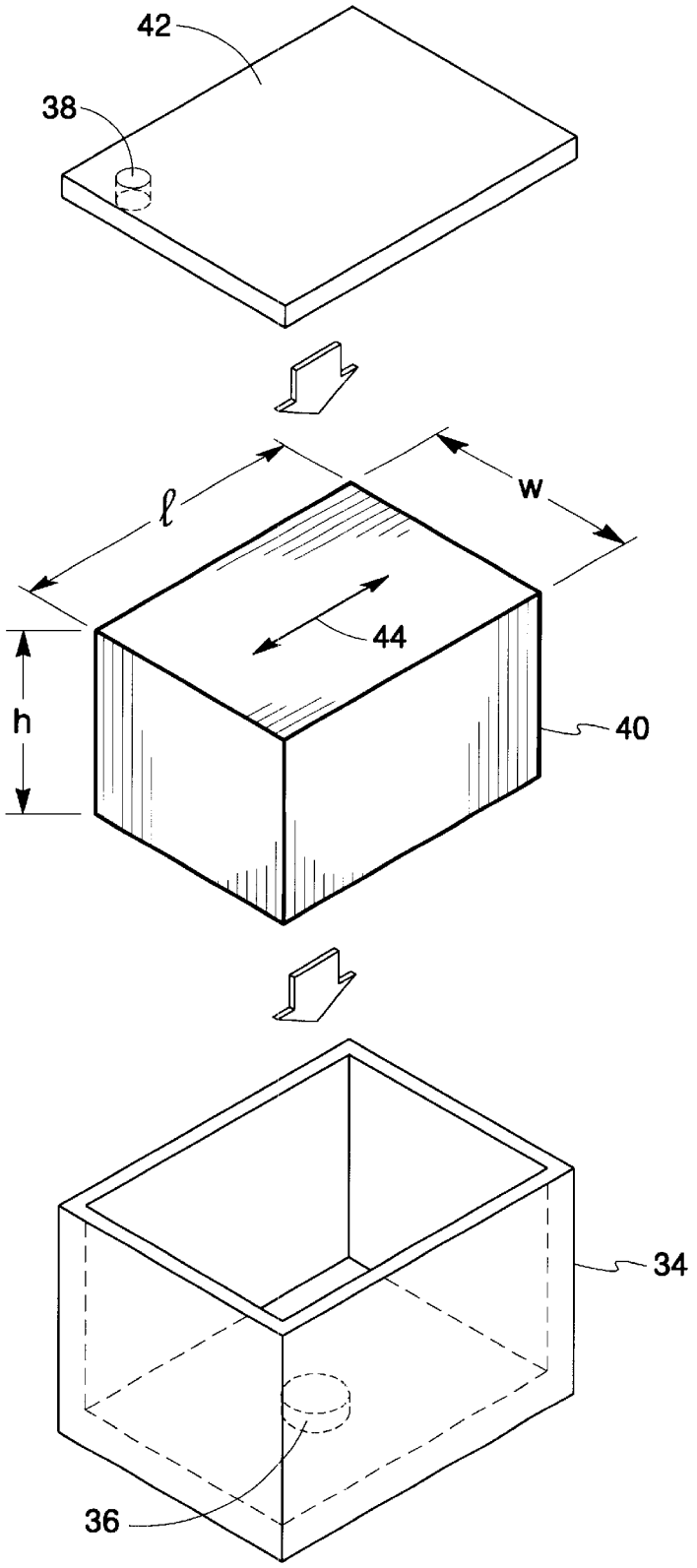
FIG. 3 is an exploded view of the ink container showing an ink reservoir, a network of fused fibers for insertion into the reservoir, and a reservoir cover for enclosing the reservoir.

FIG. 3 is an exploded view of the ink container 12 shown in FIG. 2. The ink container 12 includes an ink reservoir portion 34, the capillary member 40 and a lid 42 having an air inlet 38 for allowing entry of air into the ink reservoir 34. The capillary member 40 is inserted into the ink reservoir 34. The reservoir 34 is filled with ink as will be discussed in more detail with respect to FIG. 7. In the preferred embodiment, each of the height, width, and length dimensions indicated by H, W, and L, respectively are all greater than one inch to provide a high capacity ink container 12.

In the preferred embodiment, the capillary member 40 is formed from a network of fibers that are heat fused at points of contact. These fibers are preferably formed of a bi-component fiber having a sheath formed of polyester such as polyethylene terephthalate (PET) or a co-polymer thereof and a core material that is formed of a low cost, low shrinkage, high strength thermoplastic polymer, preferably polypropylene or polybutylene terephthalate.

The network of fibers are preferably formed using a melt blown fiber process. For such a melt blow fiber process, it may be desirable to select a core material of a melt index similar to the melt index of the sheath polymer. Using such a melt blown fiber process, the main requirement of the core material is that it is crystallized when extruded or crystallizable during the melt blowing process. Therefore, other highly crystalline thermoplastic polymers such as high density polyethylene terephthalate, as well as polyamides such as nylon and nylon 66 can also be used. Polypropylene is a preferred core material due to its low price and ease of processibility. In addition, the use of a polypropylene core material provides core strength allowing the production of fine fibers using various melt blowing techniques. The core material should be capable of forming a bond to the sheath material as well.

Figure 4A:
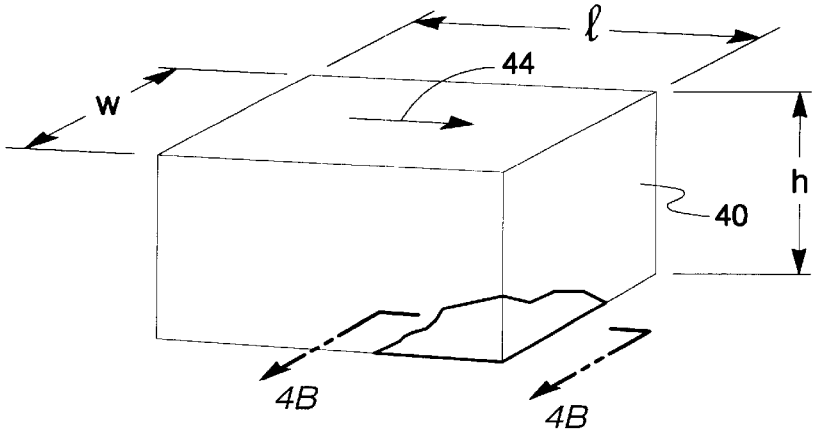
FIG. 4A is represents the network of fused fibers shown in FIG. 3.
Figure 4B:
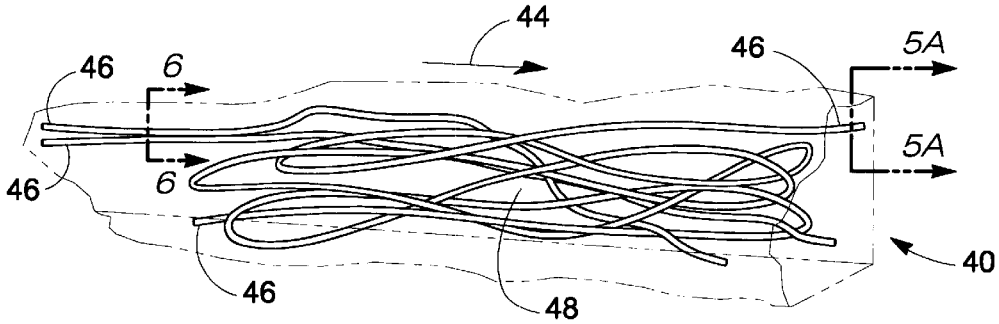
FIG. 4B is a greatly enlarged perspective view taken across lines 4B—4B of the network of fused fibers shown in FIG. 4A that are inserted into the ink reservoir shown in FIG. 3.

FIG. 4B is a greatly simplified representation of the network of fibers which form the capillary member 40, shown greatly enlarged in break away taken across lines 4A—4A of the capillary member 40 shown in FIG. 4A. The capillary member 40 is made up of a network of fibers with each individual fiber 46 being heat bonded or heat fused to other fibers at points of contact. The network of fibers 46 which make up the capillary member 40 can be formed of a single fiber 46 that is wrapped back upon itself, or formed of a plurality of fibers 46. The network of fibers form a self-sustaining structure having a general fiber orientation represented by arrow 44. The self-sustaining structure defined by the network of fibers 46 defines spacings or gaps between the fibers 46 which form a tortuous interstitial path. This interstitial path is formed to have excellent capillary properties for retaining ink within the capillary member 40.

In one preferred embodiment, the capillary member 40 is formed using a melt blowing process whereby the individual fibers 46 are heat bonded or melt together to fuse at various points of contact throughout the network of fibers. This network of fibers, when fed through a die and cooled, hardens to form a self-sustaining three dimensional structure.

Figure 5A:
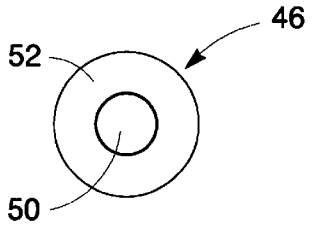
FIG. 5A is a cross section of a single fiber taken across lines 5—5 of FIG. 4.

FIG. 5A represents a cross section taken across lines 5A—5A in FIG. 4 to illustrate a cross section of an individual fiber 46. Each individual fiber 46 is a bi-component fiber, having a core 50 and a sheath 52. The size of the fiber 46 and relative portion of the sheath 52 and core 50 have been greatly exaggerated for illustrative clarity. The core material preferably comprises at least 30 percent and up to 90 percent by weight of the overall fiber content. In the preferred embodiment, each individual fiber 46 has, on average, a diameter of 12 microns or less.

Figure 5B:
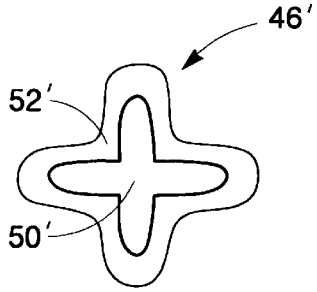
FIG. 5B is an alternative embodiment of a fiber shown in FIG. 4 having a crossshaped or x-shaped core portion.

FIG. 5B represents an alternative fiber 46 that is similar to the fiber 46 shown in FIG. 5A, except fiber 46 in FIG. 5B has a cross or x-shaped cross section instead of a circular cross section. The fiber 46 shown in FIG. 5B has a non-round or cross-shaped core 50 and a sheath 52 that completely covers the core material 50. Various other alternative cross sections can also be used, such as a tri-lobal or y-shaped fiber, or an h-shaped cross-section fiber, just to name a few. The use of non-round fibers results in an increased surface area at the fibrous surface. The capillary pressure and absorbency of the network of fibers 40 is increased in direct proportion to the wettable fiber surface. Therefore, the use of nonround fibers tends to improve the capillary pressure and absorbency of the capillary member 40.

Another method for improving the capillary pressure and absorbency is to reduce a diameter of the fiber 46. With a constant fiber bulk density or weight, the use of smaller fibers 46 improves the surface area of the fiber. Smaller fibers 46 tend to provide a more uniform retention. Therefore, by changing the diameter of the fiber 46 as well as by changing the shape of the fiber 46, the desired capillary pressure for the printing system 10 can be achieved.

Figure 6:
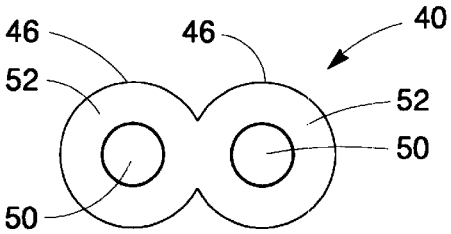
FIG. 6 is a cross section of a pair of fibers that are fused at a contact point taken across lines 6—6 shown in FIG. 4.

FIG. 6 illustrates the heat melding or heat fusing of individual fibers 46. FIG. 6 is a cross section taken across lines 66 at a point of contact between two individual fibers. Each individual fiber 46 has a core 50 and a sheath 52. At a point of contact between the two fibers 46, the sheath material 52 is melted together or fused with the sheath material of the adjacent fiber 46. The fusing of individual fibers is accomplished without the use of adhesives or binding agents. Furthermore, individual fibers 46 are held together without requiring any retaining means, thereby forming a self-sustaining structure.

Figure 7:
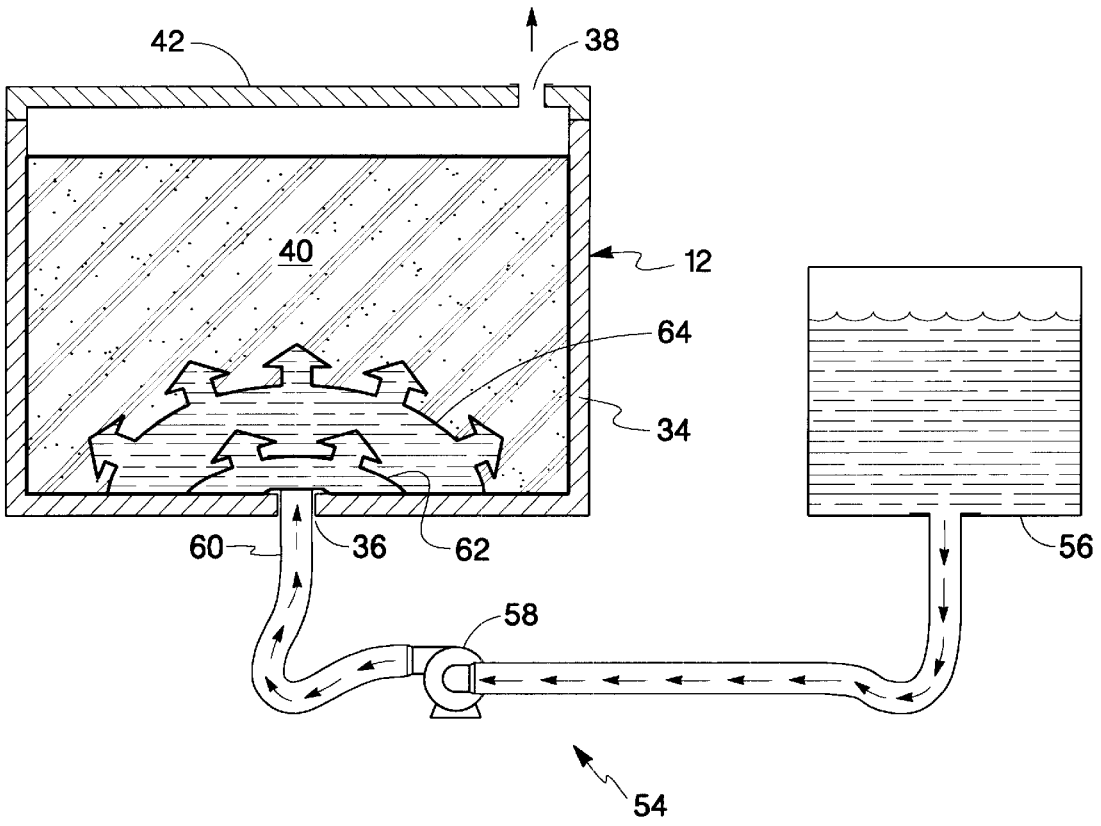
FIG. 7 is a simplified representation of the apparatus of the present invention for filling the ink container shown in FIG. 3.

FIG. 7 is a schematic illustration of the filling apparatus 54 of the present invention for filling ink into the ink container 12. The filling apparatus 54 of the present invention includes a source of ink 56, a pressurizing device 58 coupled to the source of ink 56 and a fluid interconnect 60 for coupling pressurized ink to the ink container 12. The pressurizing device 58 provides sufficient pressurization to provide ink from the source of ink 56 to the ink container 12. The pressurization required will in general be related an ink column height or ink head that must be overcome to provide ink to the fluid outlet 36 of the ink container 12. The pressurization device 58 can be a wide variety of devices sufficient to deliver a controlled amount of ink to the fluid outlet 36 of the ink container 12. For example, the pressurization device 58 can be a pump or can make us of the positioning of the source of ink 56 above the ink container 12 such that the ink head is. sufficient to deliver ink to the fluid outlet 36 of the ink container 12.

Ink is delivered to the fluid outlet 36 of the ink container 12 by the filling apparatus 54 of the present invention. As ink is delivered to the fluid outlet 36 ink is provided to a portion of the capillary storage member or network of fibers 40 adjacent the fluid outlet 36. This delivered ink is drawn into the interstitial spaces 48 between fibers 46 of the network of fibers 40 by the capillarity of this network of fibers. As ink is drawn into the interstitial spaces 48 of the network of fibers 40 air within the interstitial spaces is displaced defining an ink front 62. As ink is further delivered to the ink container 12 this ink front 62 expands outwardly into the capillary material 40 as represented by ink front 64. This expanding ink front 62, 64 tends to expand from the region proximate the fluid outlet 36 into filling interstitial spaces 48 displacing air from the network of fibers 40 in a region surrounding the fluid outlet 36. As air is displaced from the network of fibers 40 and vented through the air inlet 38 to atmosphere to prevent pressurization of the ink container 12 as ink is added. Once the proper amount of ink required to fill the ink container 12 the flow of ink from the ink container 56 is ceased.

It is preferable that the fluid interconnect 60 at least slightly compress the network of fibers 40 to create a region of increased capillary to aid in drawing ink into the capillary material 40. In one preferred embodiment, the fluid interconnect 60 is a hollow ink conduit that is inserted into the fluid outlet 36 sufficiently to compress the network of fibers 40.

It is preferable that the capillary material 40 is formed from at least one bi-component fiber having polypropylene core and a polyethylene terephthalate sheath to greatly simplify the process of filling the ink container 12. This capillary material 40 is more hydrophilic than the polyurethane foam that has been used previously as an absorbent material in thermal inkjet pens such as those disclosed in U.S. Pat. No. 4,771,295, to Baker, et al., entitled "Thermal Inkjet Pen Body Construction Having Improved Ink Storage and Feed Capability" issued Sep. 13, 1988, and assigned to the assignee of the present invention. Polyurethane foam, in its untreated state, has a large ink contact angle, therefore making it difficult to fill ink containers having polyurethane foam contained therein without using expensive and time consuming steps such as vacuum filling in order to wet the foam. Polyurethane foam can be treated to improve or reduce the ink contact angle; however, this treatment, in addition to increasing manufacturing cost and complexity, tends to add impurities into the ink which tend to reduce printhead life or reduce printhead quality. The use of the capillary member 40 of the present invention has a relatively low ink contact angle, allowing ink to be readily absorbed into the capillary member 40 without requiring treatment of the capillary member 40.

Figure 8:
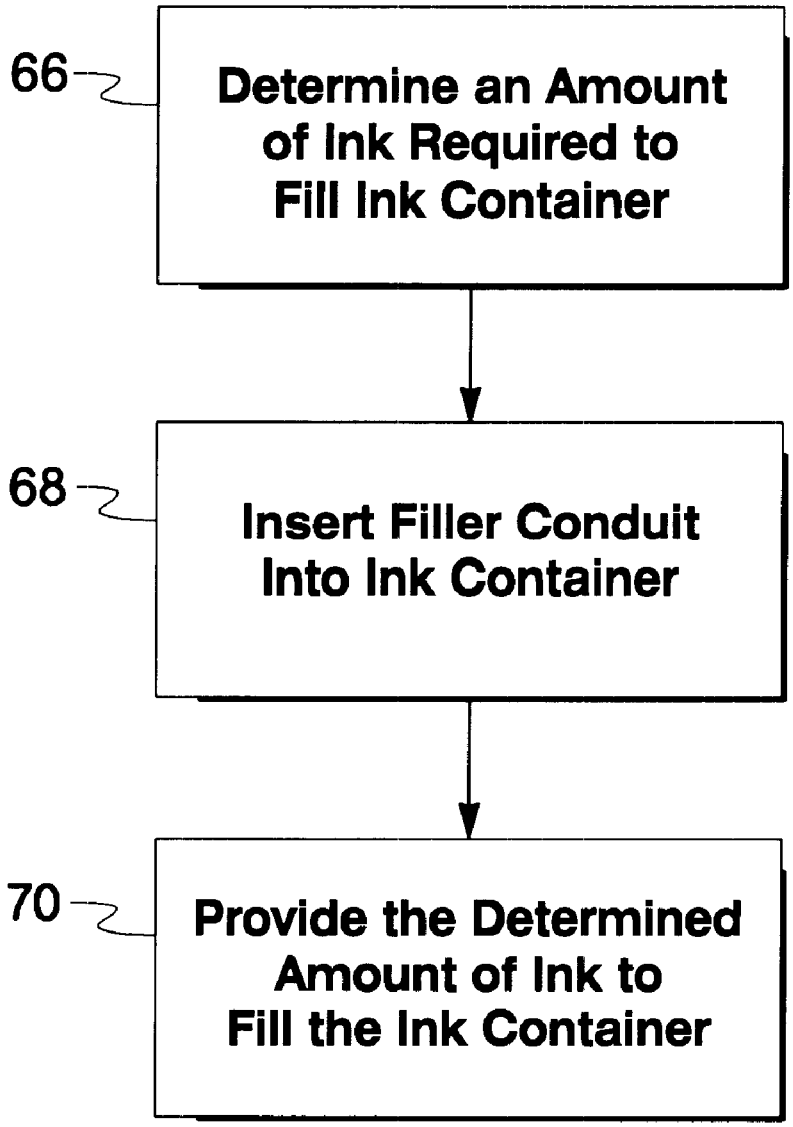
FIG. 8 is a simplified representation of the method of the present invention for filling the ink container.

FIG. 8 is a flow chart illustrating a method of the present invention for refilling the replaceable ink container 12. The method begins by determining an amount of ink required to, properly fill the replaceable ink container 12 as represented by step 66. Fluid connection is than made to the replaceable ink container 12 so that ink can be provided to the ink container as represented by step 68. In the preferred embodiment, fluid connection is accomplished by inserting a fluid interconnect 60 into the fluid outlet 36 of the replaceable ink connector 12. The amount of ink required to fill the replaceable ink container 12 is then provided to the replaceable ink container as represented by step 70.

The method and apparatus of the present invention determines the amount required to properly fill the replaceable ink container 12 and then delivers this amount to the ink container 12. It is critical that the proper amount of ink be provided to the replaceable ink container 12. If too much ink is provided to the replaceable ink container 12 and the capillary storage member 40 will have insufficient capillarity to retain this ink. If the ink container 12 cannot retain the ink, ink can leak from the reservoir 34 during handling of the ink container 12 such as during insertion and removable of the ink container 12 from the printing system 10. Furthermore, too much ink placed in the ink container 12 can result in ink leakage during changes in environmental conditions such as temperature and pressure changes. Therefore, it is critical that the ink container 12 is not overfilled during the refilling process.

The case where the printing system 10 is capable of tracking ink usage for the replaceable ink container 12 it is important that the ink container 12 is not underfilled during the refilling process. Underfilling of the replaceable ink container 12 can result in the printing system 10 inferring that ink is remaining in the ink container 12 when, in fact, the ink container 12 is exhausted of ink. The printing system 10 for this case may continue to print even when the ink container is exhausted. If the ink container 12 is sufficiently underfilled during the refilling process and the printhead can be operated without ink sometimes referred to as "dry firing" which can result in catastrophic damage to the printhead. In addition, operation of the printhead once the ink container 12 is exhausted can result in air injestion into the printhead 24. If a sufficient amount of air is injested into the printhead 24, the printhead 24 maybe incapable of properly maintaining proper back pressure within the printhead 24 which can result in ink uncontrollably leaking from the printhead 24. This ink leakage from the printhead 24 not only can reduce print quality but also damage the printing system 10.

There are several problems with determining the proper amount of ink required to fill the replaceable ink container 12. One problem is that it is difficult to determine the amount of ink remaining or stranded in the capillary storage member 40. The ink. remaining in the capillary storage member 40 is retained within the interstitial spaces of the network of fibers. Therefore, it is difficult to measure this amount of stranded ink.

Another problem with determining the amount of ink required to properly fill the replaceable ink container 12 is that frequently the replaceable ink container 12 has more than one ink compartment. Each ink compartment typically contains a different ink color.

For example, a tri-color ink container 12 has three separate compartments contained therein. Each compartment contains a different ink color such as one of cyan, magenta, and yellow inks. The printing system 10 may have previously indicated that one of the three inks is exhausted, however, the remaining two inks may have varying ink levels depending on the particular items printed. To properly refill a tri-color replaceable ink container 12 is necessary to determine an amount of ink necessary to fill each of the compartments in the replaceable ink container 12. In the case of a tri-color replaceable ink container, it is necessary to determine an amount of each of cyan, magenta, and yellow inks that are necessary for filling their respective compartments.

Figure 9:
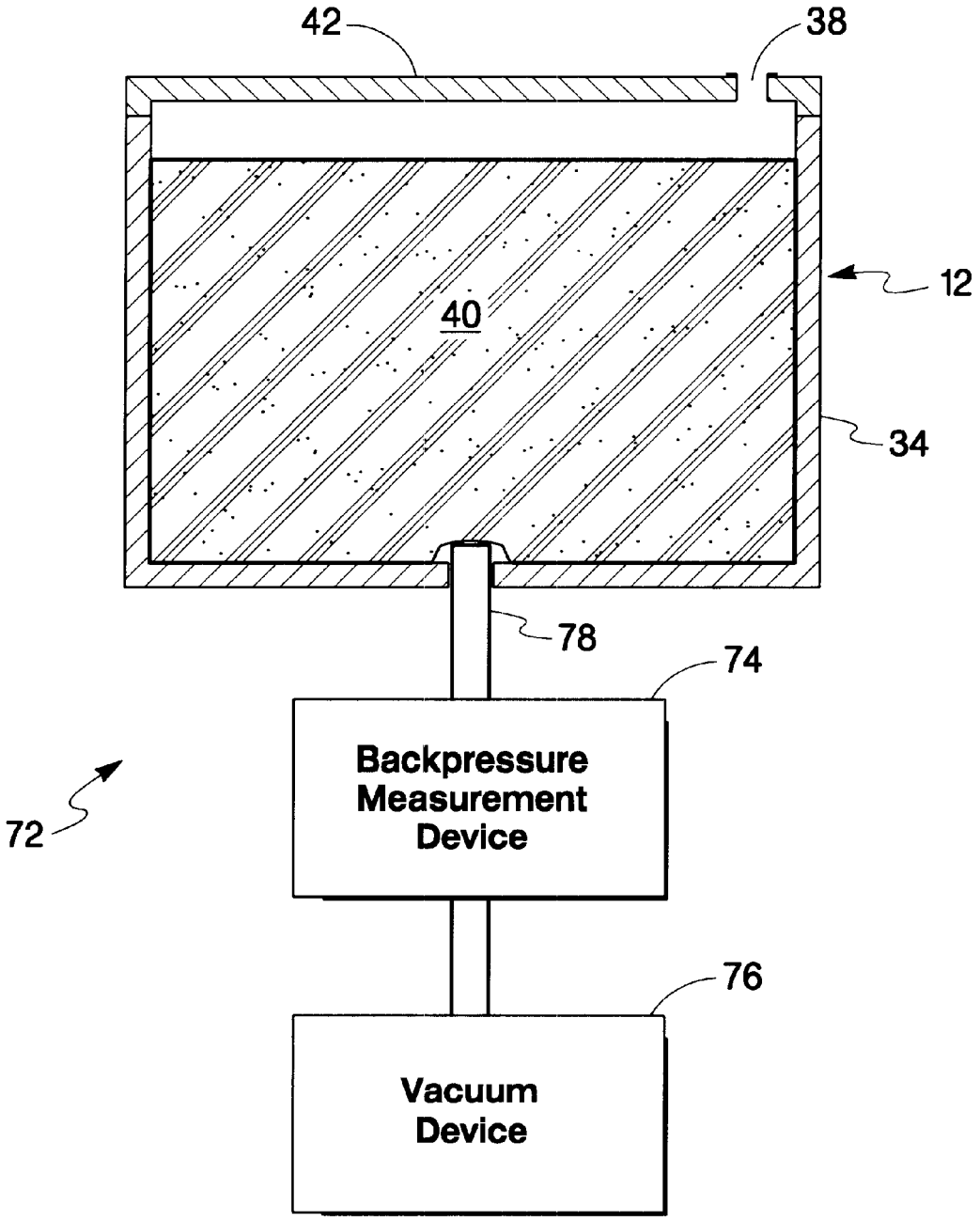
FIG. 9 is a simplified representation of the apparatus of the present invention for determining an amount of ink required to fill the ink container.
Figure 10:
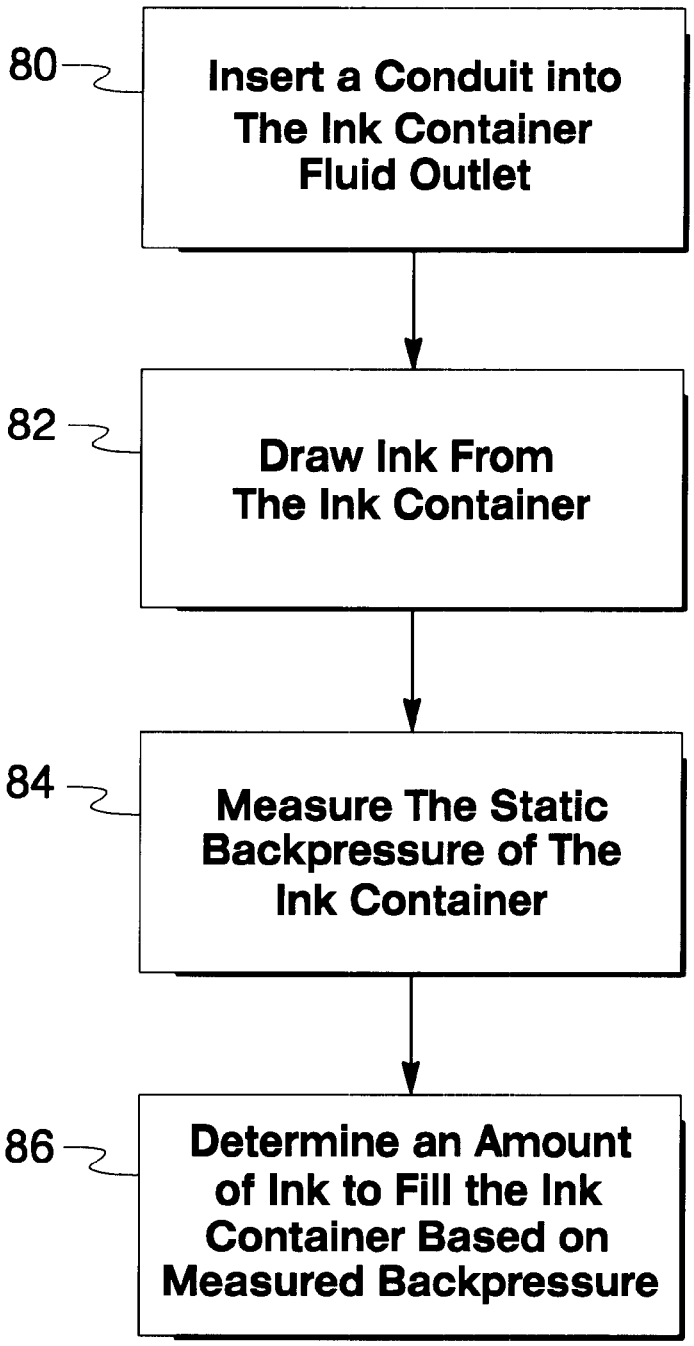
FIG. 10 is a schematic representation of a method of the present invention for determining an amount of ink required to fill the ink container.

Weighing the ink container to determine residual ink stranded in the capillary storage member 40 is suitable for determining an amount of ink required to fill a monochrome ink container 12 based on the weight of the ink container 12. However, weighing the ink container 12 is not well suited for an ink container that has more than two compartments for storing ink. Even if one were to infer one of the ink compartments were exhausted, there is no way to determine how much ink is stranded in each of the remaining two compartments. The method and apparatus of the present invention, as well will be discussed with respect to FIGS. 9 and 10, provides a technique for determining an amount of ink required to fill a replaceable ink container 12 that has three more separate compartments, each of which contains a separate quantity of ink. In the case where the ink container 12 contains less than three compartments of ink then the weighing technique previously discussed is suitable.

FIG. 9 depicts an apparatus 72 for determining an amount of ink to fill an ink container 12. The apparatus 72 includes a backpressure measurement device 74, a negative pressure or vacuum device 76, and a fluidic interconnect 78 for coupling the backpressure measurement device 74 to the capillary storage member 40 within the ink container 12. The vacuum device 76 creates a negative pressure or vacuum sufficient to overcome the capillary force retaining ink within the capillary storage member 40. The backpressure measurement device 74 then determines the backpressure or retaining force tending to retain the ink within the capillary storage member 40. By characterizing the relationship between an amount of ink within the capillary storage member 40 and the backpressure or retaining force for the capillary material 40 then an amount of ink retained within the capillary storage member 40 for a given measured back pressure can be inferred.

FIG. 10 is a flow diagram depicting the method of the present invention for determining an amount of ink to fill an ink container 12. A conduit or fluidic interconnect 78 is first inserted into the ink container 12 to engage the capillary storage member 40 as represented by step 80. Ink is then drawn from the capillary storage member 40 by the vacuum device 76 as represented by step 82. The static backpressure of the ink container 12 is then measured by the backpressure measurement device 74 as represented by step 84. Finally, based on the measured static backpressure of the ink container 12, an amount of ink stranded in the capillary storage member 40 can be inferred. The stranded ink is inferred based on the measured static backpressure and stranded ink versus backpressure of characteristics of the capillary storage member 40. Once the amount of stranded ink is inferred then an amount of ink required to fill the ink container 12 is equal to the difference between an amount of ink in a filled ink container 12 contains minus the amount of ink stranded in the capillary storage member 40.

Figure 11:
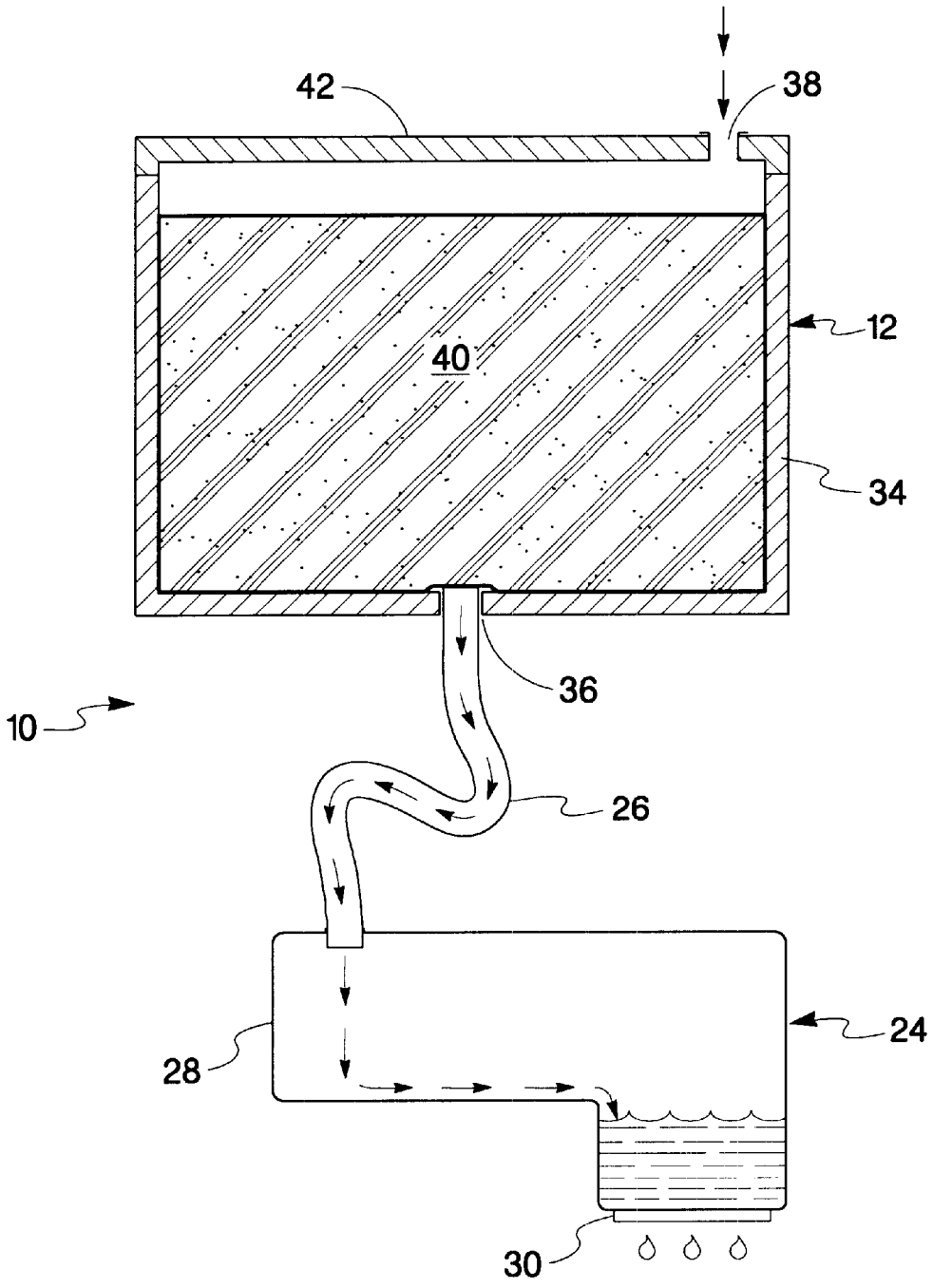
FIG. 11 is schematic representation of an inkjet printing system that includes an ink container that is refilled using the method and apparatus of the present invention.

FIG. 11 shows inkjet printing system 10 in operation. With the ink container 12 refilled using the method and apparatus of the present invention then properly installed into the inkjet printing system 10, fluidic coupling is established between the ink container 12 and the inkjet printhead 24 by way of a fluid conduit 26. The selective activation of the drop ejection portion 30 to eject ink produces a negative gauge pressure within the inkjet printhead 24. This negative gauge pressure draws ink retained in the interstitial spaces between fibers 46 within the capillary storage member 40. Ink that is provided by the ink container 12 to the inkjet printhead 24 replenishes the inkjet printhead 24. As ink leaves the reservoir through fluid outlet 36, air enters through a vent hole 38 to replace a volume of ink and exits the reservoir 34, thereby preventing the build up of a negative pressure or negative gauge pressure within the reservoir 34.

The method and apparatus of the present invention provides a technique for refilling a wide variety of ink containers 12 without over or under filling the ink container which can lead to a variety of problems previously discussed that can result one or more of the following problems, reduced print quality, damage or reduction in reliability of the printhead 24, damage or reduction in reliability of the printing system 10. In addition, the method and apparatus of the present invention fills the ink container 12 from the fluid outlet 36 thereby providing a uniform ink front 62, 64 that expands into the capillary storage member 40 displacing air from the fluid outlet 36. Once the ink container 12 is installed into the printing system 10 ink drawn from the capillary material 40 will tend to have little, if any, air bubbles that are drawn in from the capillary storage material 40. Filling the ink container 12 in this manner tends to reduce air ingestion by the printing system 10 that tends to increase the reliability of the printing system 10.

What is claimed is:

1. An apparatus for refilling a replaceable ink container, the ink container having a top and bottom portion relative to a gravitational frame of reference, the replaceable ink container further having a capillary storage member disposed therein and a fluid outlet disposed on the bottom portion, the apparatus for refilling comprising:

a fluid interconnect configured for insertion into the bottom portion to compress the capillary storage member;

means for determining an amount of ink to fill the replaceable ink container; and an ink delivery device for providing the determined quantity of ink to the replaceable ink container through the fluid interconnect, the ink delivery device configured to deliver ink to the ink container positioned in a bottom down orientation relative to the gravitational frame of reference to provide ink to the capillary storage member proximate the fluid outlet.

2. The apparatus for refilling of claim 1 wherein the ink delivery device is configured to provide ink to the ink container so that air is displaced from the capillary storage member in a region proximate the fluid outlet.

3. The apparatus for refilling of claim 1 wherein the ink delivery device is configured to provide ink to the ink container so that an ink front expands outwardly in the capillary storage member in a region proximate the fluid outlet.

4. The apparatus of claim 1 wherein the ink delivery device is configured to provide ink to the replaceable ink container to displace air from the capillary storage member in as ink is introduced to the capillary storage member.

5. The apparatus of claim 1 wherein the means for determining an amount of ink is a backpressure measuring device for measuring backpressure tending to draw ink toward the capillary storage material.

6. The apparatus of claim 1 wherein the means for determining an amount of ink is a device for weighing the replaceable ink container.

7. The apparatus of claim 1 wherein the fluid interconnect is a hollow conduit that is inserted through the fluid outlet to compress the capillary storage material.

8. The apparatus of claim 1 wherein the ink delivery device includes a supply of ink and a pressurizing device connected to the supply of ink, the pressurizing device pressurizing ink provided by the supply of ink sufficiently to fill ink into the replaceable ink container.

9. A method for refilling a replaceable ink container having a capillary storage member disposed therein for retaining ink, the method comprising:

determining a quantity of ink to replenish the replaceable ink container based on backpressure tending to retain ink within the capillary storage member; and providing the determined quantity of ink to the replaceable ink container so that the capillary storage member is replenished with ink.

10. The method of claim 9 wherein prior to determining a quantity of ink to replenish the replaceable ink container drawing ink from the capillary storage member.

11. The method of claim 9 wherein providing the determined quantity of ink to the replaceable ink container is performed through a fluid outlet on a bottom portion of the replaceable ink container with the ink container positioned in a bottom down orientation relative to a gravitational frame of reference to provide ink to the capillary storage member proximate the fluid outlet.

12. The method of claim 9 wherein providing the determined quantity of ink to the replaceable ink container is performed to provide an ink front expands outwardly into the capillary storage member from a region proximate the fluid outlet.

13. The method of claim 9 wherein providing the determined quantity of ink to the replaceable ink container is performed to displace air from the capillary storage member in as ink is introduced to the capillary storage member.

* * * * *

UNITED STATES PATENT AND TRADEMARK OFFICE

CERTIFICATE OF CORRECTION

PATENT NO. : 6,402,306 B1
DATED : June 11, 2002
INVENTOR(S) : Childers et al.

It is certified that error appears in the above-identified patent and that said Letters Patent is hereby corrected as shown below:

Column 1,
Line 3, insert the following paragraph:

-- This application is a continuation-in-part of pending application serial number 09/430,400, filed October 29, 1999, entitled INK RESERVOIR FOR AN INKJET PRINTER. --

Signed and Sealed this

Twenty-ninth Day of April, 2003

JAMES E. ROGAN
*Director of the United States Patent and Trademark Office*